US008672527B2

(12) United States Patent
Finell

(10) Patent No.: US 8,672,527 B2
(45) Date of Patent: Mar. 18, 2014

(54) LUMINOUS LIGHT APPARATUS

(75) Inventor: Rebecca M. Finell, Tempe, AZ (US)

(73) Assignee: BKD Acquisition, Inc., Oak Brook, IL (US)

( * ) Notice: Subject to any disclaimer, the term of this patent is extended or adjusted under 35 U.S.C. 154(b) by 546 days.

(21) Appl. No.: 12/508,118

(22) Filed: Jul. 23, 2009

(65) Prior Publication Data

US 2011/0019427 A1 Jan. 27, 2011

(51) Int. Cl.
*F21K 2/00* (2006.01)

(52) U.S. Cl.
USPC ..... 362/577

(58) Field of Classification Search
USPC ..... 362/565, 577, 155, 806–811
See application file for complete search history.

(56) References Cited

U.S. PATENT DOCUMENTS

| | | | | | |
|---|---|---|---|---|---|
| 4,970,793 | A * | 11/1990 | Atamian | ..... | 33/268 |
| 5,330,195 | A * | 7/1994 | Gulick | ..... | 473/200 |
| 5,947,789 | A * | 9/1999 | Chan | ..... | 446/219 |
| 6,582,115 | B2 * | 6/2003 | Huang | ..... | 362/565 |
| 6,837,607 | B2 * | 1/2005 | Wagner | ..... | 362/565 |
| 2003/0016529 | A1 * | 1/2003 | Schuren et al. | ..... | 362/109 |
| 2004/0179352 | A1 * | 9/2004 | Anderson et al. | ..... | 362/109 |
| 2004/0266554 | A1 * | 12/2004 | Park et al. | ..... | 473/353 |
| 2006/0199671 | A1 * | 9/2006 | Town | ..... | 473/417 |

* cited by examiner

*Primary Examiner* — Julie Bannan
(74) *Attorney, Agent, or Firm* — Michael Best & Friedrich LLP

(57) ABSTRACT

A luminous light apparatus includes a housing structure formed with a cradle and a light source, a luminous body movable between a first position removably held by the cradle, and a second position removed with respect to the cradle, the luminous body light coupled for exposure to light from the light source in the first position of the luminous body held by the cradle, and the luminous body to emit visible light for some time after exposure of the luminous body to light from the light source.

13 Claims, 11 Drawing Sheets

LUMINOUS LIGHT APPARATUS

FIELD OF THE INVENTION

The present invention relates to lights and lamps for use in domestic settings.

BACKGROUND OF THE INVENTION

Familiar is the scene of a child under bed covers with a flashlight. A flashlight can provide security in a dark house at night, and can be fun for kids to play with. However, flashlights and other similar portable lights require batteries that must be repeatedly replaced when they wear out, and have electrical parts that can easily break. Although batteries are an acceptable power source for flashlights and other portable lights, they often wear out at the most inopportune times.

Of particular interest are nightlights, which are useful to children in allaying their fears at night or in dark settings. There are a wide variety of nightlights, most of which use incandescent light bulbs, neon lamps, light emitting diodes, or the like, and must be plugged into an electrical outlet to receive electrical power in order to be operative. However, such lights and light bulbs eventually break or wear out rendering the nightlight inoperative requiring light or bulb replacement, and electrically powered night lights simply do not work during power outages. Furthermore, nightlights that operate from an electrical outlet are not portable, and therefore cannot be taken up and carried about as may be desired, such as to illuminate the way of a child walking about in a dark house or a dark setting.

SUMMARY OF THE INVENTION

What is needed, therefore, is a device that utilizes a fun, easy to use, portable light that kids can carry with them to bed without the need for batteries or the worry of breaking, and that utilizes luminescent bodies or balls that are set onto a base for charging. As the luminescent bodies or balls charge through exposure to light generated by low energy light emitting diodes formed in the base, they provide illumination and serve as a stylish nightlight. By using energy saving technology and eliminating batteries with the use of luminescent bodies or balls, such a device constructed and arranged in accordance with the principle of the invention has a minimal impact on the environment.

According to the principle of the invention, a luminous light apparatus includes a housing structure formed with a cradle and a light source, a luminous body movable between a first position removably held by the cradle, and a second position removed with respect to the cradle, the luminous body light coupled for exposure to light from the light source in the first position of the luminous body held by the cradle, and the luminous body to emit visible light for some time after exposure of the luminous body to light from the light source. A switch is operatively coupled to activate and deactivate the light source. A channel is formed between the light source and the cradle to light couple the light source to the luminous body in the first position of the luminous body removably held by the cradle. At least one reflective surface is formed in the housing structure, and is positioned to reflect light from the light source to the luminous body in the first position of the luminous body removably held by the cradle.

According to the principle of the invention, a luminous light apparatus includes a base, a light source formed in the base, a fixture having a lower end attached to the base and extending upwardly therefrom to an opposed upper end formed with a cradle, a luminous body movable between a first position removably held by the cradle, and a second position removed with respect to the cradle, the fixture to light couple the luminous body for exposure to light from the light source formed in the base in the first position of the luminous body held by the cradle, and the luminous body to emit visible light for some time after exposure of the luminous body to light from the light source. A switch is formed in the base, which is operatively coupled to activate and deactivate the light source. A channel is formed in the fixture between the lower end of the fixture and the cradle formed in the upper end of the fixture to light couple the light source to the luminous body in the first position of the luminous body removably held by the cradle. At least one reflective surface is formed in the fixture at the channel to reflect light from the light source to the luminous body in the first position of the luminous body removably held by the cradle.

According to the principle of the invention, a luminous light apparatus includes a base, a light source formed in the base, a fixture, a luminous body held by the fixture, the fixture movable between a first position attached to the base, and a second position removed with respect to the base, the fixture to light couple the luminous body for exposure to light from the light source formed in the base in the first position of the fixture attached to the base, and the luminous body to emit visible light for some time after exposure of the luminous body to light from the light source. A switch is formed in the base, which is operatively coupled to activate and deactivate the light source. A channel is formed in the fixture to light couple the light source to the luminous body in the first position of the fixture attached to the base. At least one reflective surface is formed in the fixture at the channel to reflect light from the light source to the luminous body in the first position of the fixture attached to the base.

According to the principle of the invention, a luminous light apparatus includes a base, a light source formed in the base, a fixture formed with a cradle, a luminous body movable between a first position removably held by the cradle, and a second position removed with respect to the cradle, the fixture movable between a first position attached to the base, and a second position removed with respect to the base, the fixture to light couple the luminous body for exposure to light from the light source formed in the base in the first position of the fixture attached to the base and the first position of the luminous body removably held by the cradle, and the luminous body to emit visible light for some time after exposure of the luminous body to light from the light source. A switch is formed in the base, which is operatively coupled to activate and deactivate the light source. A channel is formed in the fixture to light couple the light source to the luminous body in the first position of the fixture attached to the base and the first position of the luminous body removably held by the cradle. At least one reflective surface is formed in the fixture at the channel to reflect light from the light source to the luminous body in the first position of the fixture attached to the base and the first position of the luminous body removably held by the cradle.

BRIEF DESCRIPTION OF THE DRAWINGS

Referring to the drawings.

DETAILED DESCRIPTION OF A PREFERRED EMBODIMENT

Figure 1:
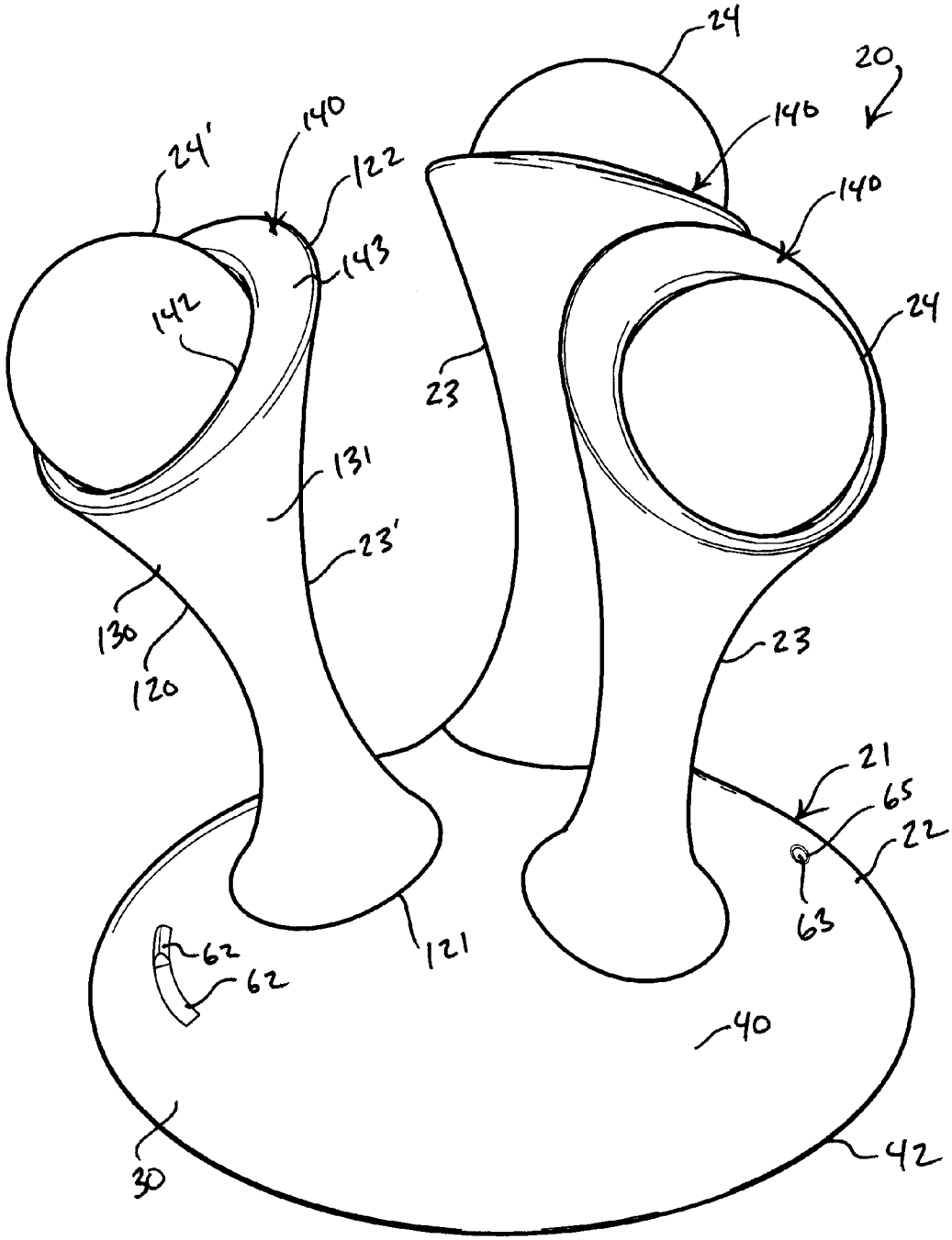
FIG. 1 is perspective view of a luminous lamp apparatus constructed and arranged in accordance with the principle of the invention, the luminous lamp apparatus including a housing structure formed of base, and fixtures attached to and extending upwardly from the base each formed with a cradle holding a luminous body.
Figure 2:
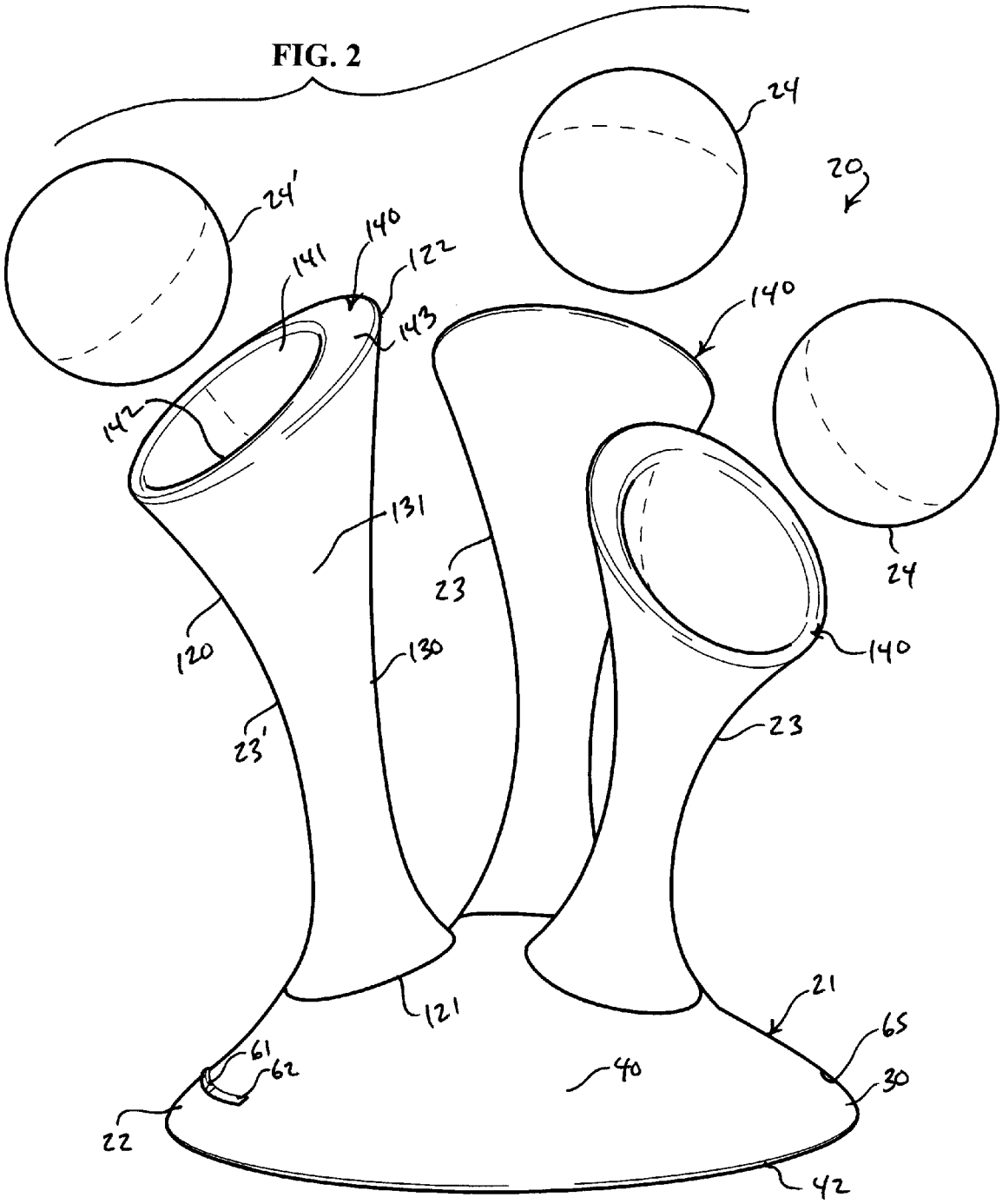
FIG. 2 is a perspective view of the luminous lamp apparatus of FIG. 1 illustrating the luminous bodies removed with respect to the fixtures.

Turning now to the drawings, in which like reference characters indicate corresponding elements throughout the several views, attention is first directed to FIG. 1, which illustrates a luminous lamp apparatus 20 constructed and arranged in accordance with the principle of the invention including a housing structure 21, consisting of a base 22 and fixtures 23 supported by base 22, and luminous bodies 24, which are held by fixtures 23 and which are exposed to light at fixtures 23 from light sources maintained by base 22 at fixtures 23 and that emit visible light through luminescence for some time after exposure to the light from the light sources maintained by base 22. Fixtures 23 are each adapted to removably receive and hold one luminous body 24. More particularly, luminous bodies 24 are movable between a first position removably held by the respective fixtures 23 as illustrated in FIG. 2, and a second position removed with respect to the respective fixtures 23 as illustrated in FIG. 2. Base 22 and fixtures 23 of housing structure 21 are each formed preferably of plastic, such as polyethylene, polyvinyl chloride, polypropylene, or the like, and are each integrally formed, such as by conventional molding techniques, or formed of two or more attached parts. In the present embodiment, apparatus 20 has three sets of fixtures 23 and luminous bodies 24, and less or more sets may be used as may be desired in conjunction with apparatus 20 without departing from the invention.

Base 22 is the main support of housing structure 21. In the present embodiment, base 22 consists of a broad, substantial body 30 that, with reference to FIGS. 3 and 4, consists of a cover or dome 30 and a bottom 31. Dome 30 is broad and generally circular in shape and has an upper surface 40 and an opposed lower surface 41 (not referenced in FIG. 3) that each extend outward to a perimeter edge 42 of dome 40. Dome 30 overlies and is set atop bottom 31, which is broad and flat and substantially circular in shape much like a disk, and which includes opposed parallel inner and outer surfaces 50 and 51 (outer surface 51 not referenced in FIG. 3) that extend outward to a perimeter edge 52 affixed to perimeter edge 42 of dome 30 as shown in FIG. 4. Perimeter edge 52 of bottom 31 is affixed to perimeter edge 42 of dome 30 with an adhesive, although welding can be used if so desired. In other embodiments, mutual snap fasteners or other form of mechanical engagement pair or structure can be formed between perimeter edge 52 of bottom 31 and perimeter edge 42 of dome 30 to secure dome 30 to bottom 31 without departing from the invention.

As seen in FIG. 4, the attachment of dome 30 to bottom 31 forms base 22, which is hollow. More particularly, lower surface 41 of dome 30 opposes inner surface 50 of bottom to form a chamber 55 therebetween encircled by the perimeter of base 22 formed by the joined perimeter edges 42 and 52 of dome 30 and bottom 31, respectively. Outer surface 51 of bottom 31 of base 22 is flat, and bottom 31 is to be positioned on a support surface providing a stable platform. Outer surface 51 of bottom is formed with non-slip material 51A denoted in FIGS. 4, 5, 8, 10, and 11, such as rubber, silicone, or the like, which prevents base 22 from slipping across the surface upon which it is set. A non-slip surface may be provided by way of an elastomer or a pattern of elastomer elements overmolded or otherwise applied onto outer surface 51 of bottom 31. Base 22 is overall generally circular in shape, and may be formed to take on other shapes or designs as may be desired. Base 22 supports the electrical wiring and light sources of apparatus 20, which will now be discussed in detail.

With continuing reference to FIG. 4, base 22 is formed with an electrical system and light sources. The electrical system consists of a power converter 60 formed with a switch 61. Power converter 60 is positioned in chamber 55 of base 22, and is held in place with adhesive, screws, rivets, or the like. With momentary attention directed to FIGS. 1 and 2, switch 61 is part of power converter 60 and is located in an elongate, somewhat curved opening or slot 62 to permit user access to switch 61 from an exterior position with respect to base 22 to activate and deactivate switch 61 by moving it back and forth in slot 62 between ON and OFF positions to activate and deactivate power converter 60. Power converter 60, including its switch 61, are entirely conventional and well-known in the art, further details of which will, therefore, not be discussed.

Looking back to FIG. 4, power converter 60 is electrically coupled to a jack 63 formed in base 22 with conventional electrical wiring 64. Jack 63 is entirely conventional and is formed in, and held by, a small opening 65 formed in dome 30, and configured to accept by insertion a plug 70 of a conventional power cord 71 to establish electrical contact therebetween. Power cord 71 is formed with two plugs, which include plug 70 configured to be inserted into jack 63, and an opposed plug 72 configured to be plugged into an electrical socket, such as a conventional wall socket, to establish electrical contact to supply power to power converter 60 via power cord 71 and electrical wiring 64. Power converter 60 is electrically coupled to light sources maintained by base 22, and applies power to the light sources in response to activation of switch 61 to its ON position activating power converter 60 electrically coupled to a power source Referencing FIG. 3, dome 30 is formed with holders 80, which each maintain a light source electrically coupled to power converter 60. There are three holders 80 in the present embodiment, which are arranged in a generally triangular pattern at a central location with respect to dome 30 substantially equidistant from each other and with respect to perimeter edge 42. Holders 80 and the respective light sources are identical in structure and function. Accordingly, the details of one of holders 80, which holder is denoted at 80' for ease of discussion and reference, and its corresponding light source will now be discussed with the understanding the ensuing discussion applies to each holder 80 and corresponding light source.

Figure 3:
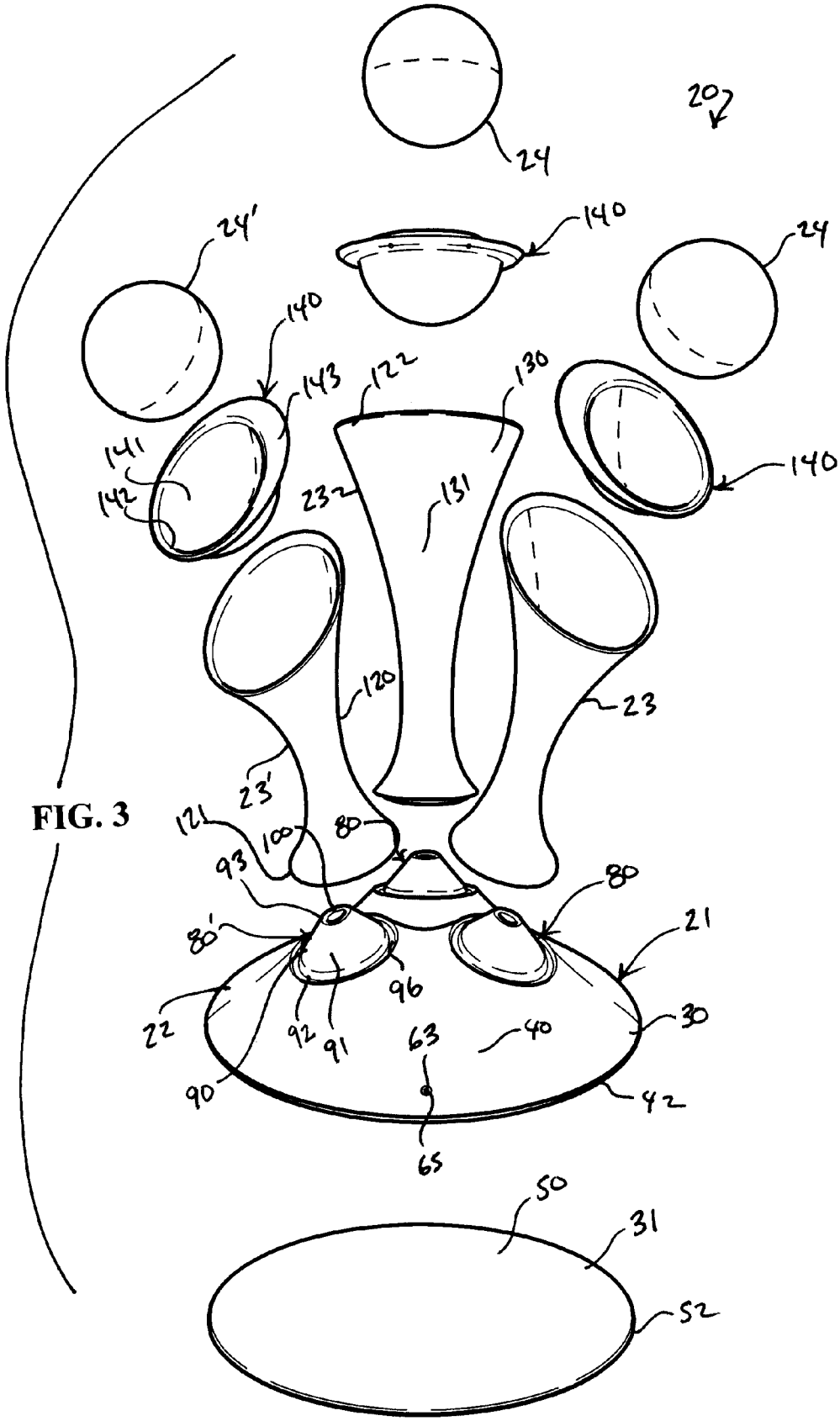
FIG. 3 is a partially exploded perspective view of the luminous lamp apparatus of FIG. 1.
Figure 4:
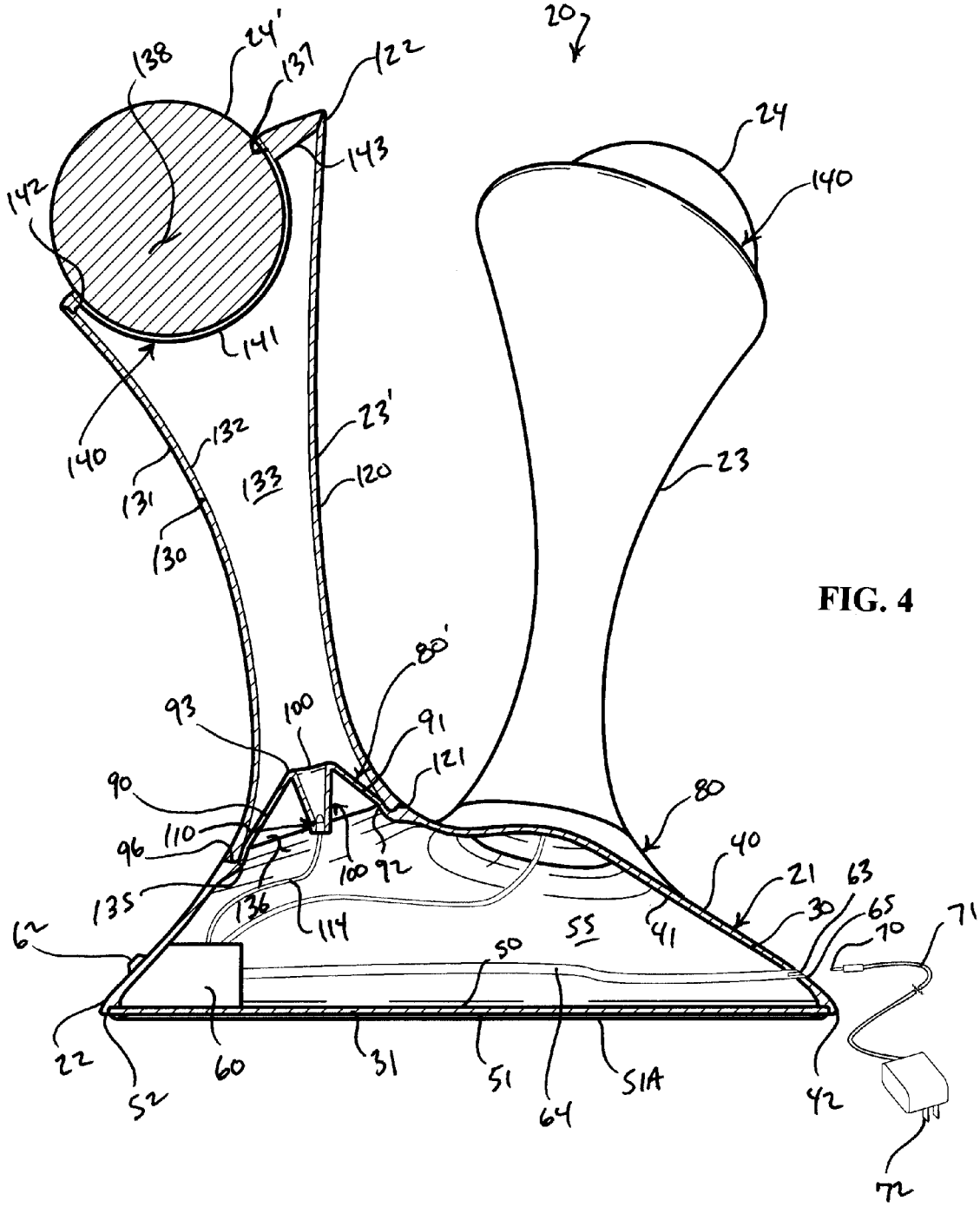
FIG. 4 is a vertical section view of the luminous lamp apparatus of FIG. 1.
Figure 5:
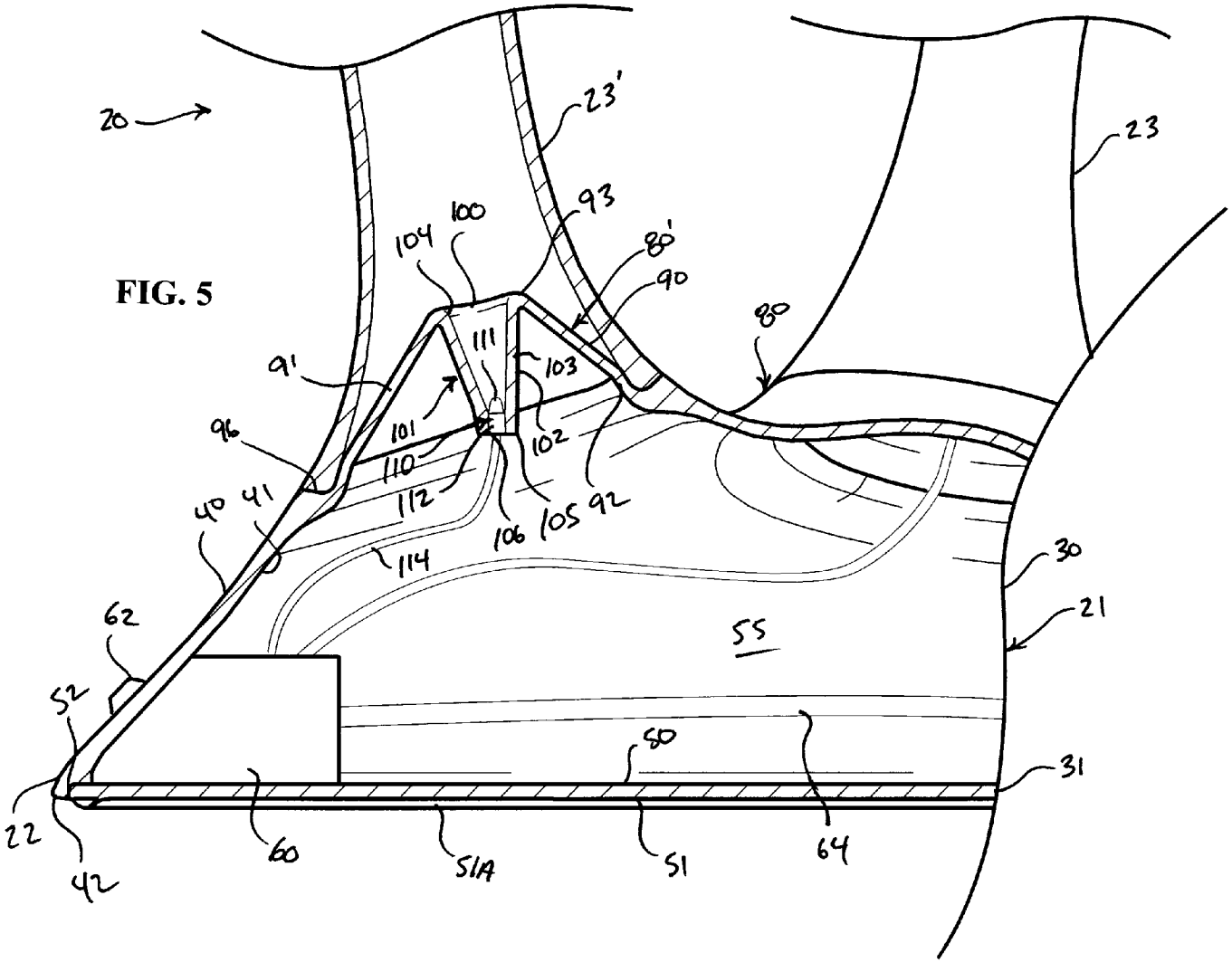
FIG. 5 is an enlarged vertical section view of the luminous lamp apparatus of FIG. 1.

Referencing FIGS. 3-5, holder 80' consists of a generally cone-shaped body 90 including a continuous sidewall 91 having a lower end 92 formed in dome 30, and which extends and tapers upwardly therefrom with respect to upper surface 40 of dome 30 to a tapered upper end 93 formed with an opening 100. Lower end 92 is a continuous perimeter edge of continuous sidewall 91, and a continuous depression or recess 96 is formed in upper surface 40 of dome 30 encircling the continuous perimeter edge forming lower end 92. In this example, continuous perimeter edge forming lower end 92 of continuous sidewall 91 is circular in shape, as is the encircling continuous depression or recess 96.

Looking to FIG. 5, a receptacle 101 is formed in upper end 93 of holder 80', which supports a light source 110. Receptacle 101 extends downwardly into chamber 55 with respect to opening 100 formed in upper end 93 of holder 80'. Receptacle 101 consists of an inverted, generally cone-shaped body 102 including a continuous sidewall 103 having an upper end 104 formed in upper end 93 of holder 80' that encircles and at least partially defines opening 100 formed in upper end 93 of holder 80', and which extends and tapers downwardly therefrom with respect to opening 100 to a tapered lower end 105 that holds light source 110. Light source 110 consists of light 111 electrically coupled to a socket 112. An opening 106 is formed in lower end 105 of receptacle 101, within which is mounted and secured socket 112. Light 111 projects upwardly from socket 112 toward opening 100 formed in upper end 93 of holder 80'. Socket 112 is secured in place to receptacle 101 at opening 106 with adhesive, and may, in other examples, be press fit in place, threadably secured in place, or secured with one or more fasteners, such as a screw, rivet, or the like. Socket 112 is electrically coupled to power converter 60 with conventional electrical wiring 114 to convey electrical power from power converter 60 to light 111 to activate or energize and thus illuminate light 111, which light generated by light 111 shines upwardly through receptacle 101 and outwardly through opening 100 formed in upper end 93 of holder 80'. In this example, light 111 is conventional and well-known full spectrum, low energy use, high brightness light emitting diode (LED), and socket 112 is a conventional and well-known LED socket, further details of which are very well known and will not be discussed in further detail. Light 111 is a LED in a preferred embodiment because it is a low energy use light source that generates high brightness light.

As previously mentioned in conjunction with FIGS. 1 and 2, fixtures 23 are supported by base 22, and fixtures 23 are each adapted to removably hold one luminous body 24. Fixtures 23 each relate to one of holders 80. Fixtures 23 and the respective luminous bodies 24 are identical in structure and function. Accordingly, the details of one of fixtures 23, which is denoted at 23' for ease of discussion and reference, and its corresponding luminous body 24, which is denoted at 24' for ease of discussion and reference, will now be discussed with the understanding the ensuing discussion applies to each fixture 23 at its corresponding luminous body 24. The ensuing will relate fixture 23' and luminous body 24' to its related holder, which, in this particular example, is holder 80'.

Referencing FIGS. 1-4, fixture 23' consists of an elongate body 120 having a lower end 121 and an opposed upper end 122. Lower end 121 is attached to base 22 at holder 80', referenced in FIGS. 3 and 4, and extends upwardly or otherwise upright from base 22 to upper end 122, and this is illustrated in FIGS. 1, 2 and 4. Referencing FIG. 4, elongate body 120 is formed by an elongate continuous sidewall 130 having a continuous outer surface 131, and an opposed continuous inner surface 132 that encircles and bounds a channel 133 extending through fixture 23' between lower end 121 and upper end 122. A continuous edge 135 is formed in lower end 121 of elongate body 120, which encircles and bounds an opening 136 to channel 133 at lower end 121 of elongate body 120. As illustrated in FIGS. 3 and 4, a continuous edge 137 is formed in upper end 122 of elongate body 120, which encircles and bounds an opening 138 to channel 133 at upper end 122 of elongate body 120.

Fixture 23' is movable between a first position attached to base 22 as illustrated in FIGS. 1, 2, and 3, and a second position removed with respect to base 22 as illustrated in FIG. 3. In the first position of fixture 23' attached to base 22, fixture 23' extends upright or otherwise substantially vertically upward from base 22 from lower end 121 of fixture 23' attached to base to upper end 122 of fixture 23'. In the first position of fixture 23' attached to base 22 with reference to FIG. 4 and FIG. 5, opening 136 formed in lower end 121 of elongate body 120 is registered with holder 80', and fixture 23' is applied toward holder 80' formed in dome 30 of base 21, and continuous edge 135 is matingly received in recess 96 locating holder 80' in channel 133 at lower end 121 of elongate body 120 through opening 136 formed in lower end 121 of elongate body 120. Continuous edge 135 formed in lower end 121 of elongate body 120 matingly corresponds to recess 96 formed in upper surface 40 of dome 30 of base 22. In applying continuous edge 135 to recess 96, holder 80' and opening 136 formed in lower end 121 of elongate body 120 are comparatively sized to allow holder 80' to pass through opening 136 into channel 133 at lower end 121 of elongate body 120 encircling holder 80'. Recess 96 is a form of a cradle that is a support which receives, engages, and holds lower end 121 of elongate body 120 of fixture 23' set substantially vertically onto base 30.

Referencing FIG. 4, upper end 122 is adapted to removably receive and hold luminous body 24'. Luminous body 24' is movable between a first position removably held by upper end 122 of elongate body 120 of fixture 23' at opening 138 as illustrated in FIG. 4, and a second position removed with respect to upper end 122 of elongate body 120 of fixture 23' as illustrated in FIG. 2. In the first position of fixture 23' attached to base 22 and the first position of luminous body 24' removably held by upper end 122 of elongate body 120 of fixture 23' at opening 138, as illustrated in FIG. 4, fixture 23' light couples luminous body 24' for exposure to light from light source 110 formed in holder 80' of base 22, which means that light from light source 110 produced by the activation and illumination of light source 110 passes through channel 133 from holder 80' at lower end 121 of elongate body 120 of fixture 23' to luminous body 24' at upper end 122 of elongate body 120 of fixture 23' to thereby expose luminous body 24' at opening 138 at upper end 122 of elongate body 120 of fixture 23' to light generated by light source 110. In other words, in the first position of fixture 23' attached to base 22 and the first position of luminous body 24' removably held by upper end 122 of elongate body 120 of fixture 23' at opening 138, as illustrated in FIG. 4, luminous body 24' is light coupled by fixture 23' for exposure to light from light source 110 formed in holder 80' of base 22, which again means that light from light source 110 produced by the activation and illumination of light source 110 passes through channel 133 from lower end 121 of elongate body 120 of fixture 23' to luminous body 24' at upper end 122 of elongate body 120 of fixture 23' to thereby expose luminous body 24' at opening 138 at upper end 122 of elongate body 120 of fixture 23' to light generated by light source 110. In the present example, there is a direct line of sight through channel 133 between light source 110 of holder 80' at lower end 121 of elongate body 120 of fixture 23' and luminous body 24' held by upper end 122 of elongate body 120 of fixture to thereby expose luminous body 24' to light generated by light source 110 shining upwardly from holder 80' through channel 133 and to luminous body 24'.

To assist in directing light from light source 110 to luminous body 24' removably received and held at upper end 122 of elongate body 120 of fixture 23', continuous inner surface 132 of elongate body 120 of fixture 23' that encircles and bounds a channel 133 extending through fixture 23' between lower end 121 and upper end 122 is a reflective surface to reflect light from light source 110 to luminous body 24' in the first position of the luminous body removably held by upper end 122 of elongate body 120 of fixture 23'.

Upper end 122 of elongate body 120 of fixture 23' is formed with a cradle 140. Cradle 140 is provided to removably receive and hold luminous body 24' with respect to upper end 122 of elongate body 120 of fixture 23'. Referencing FIGS. 3 and 4, cradle 140 consists of a basin or bowl 141, which has an annular rim 142 and an annular flange 143 encircling and projecting outward with respect to the annular rim 142. Looking to FIG. 4, cradle 140 is installed in upper end 122 of elongate body 120 of fixture 23'. In particular, bowl 141 is directed into and through opening 138 formed in upper end 122 and flange 143 is presented against continuous edge 137 encircling and bounding opening 138 through upper end 122 of elongate body 120 of fixture 23' that communicates with channel 133 extending through fixture 23' from opening 136 formed at lower end 121 of elongate body 120 of fixture 23' to opening 138 formed at upper end 122 of elongate body 120 of fixture 23'. If desired, flange 143 can be secured in place with respect to continuous edge 137 with adhesive, clips, mutual snap fasteners, or the like. With flange 143 positioned against and atop continuous edge 137 at upper end 122 of elongate body 120 of fixture 23' and thereby positioned and held in place, cradle 140 is held in place and installed with respect to upper end 122 of elongate body 120 of fixture 23'.

Bowl 141 extends into and through opening 138 formed in upper end 122 of elongate body 120 of fixture 23', and is sized to removably receive and hold luminous body 24'. To install luminous body 24' with respect to cradle 140, luminous body 24' is simply taken up, such as by hand, and passed into bowl 141 through opening 138. So placed in cradle 140, approximately half of luminous body 24' extends into channel 133 through opening 138, with the rest of luminous body 24' extending upwardly and away from opening 138 and upper end 122 of elongate body 120 of fixture 23'. To remove luminous body 24' from cradle 140 one need only reverse the operation to install luminous body 24' by taking up luminous body 24', such as by hand, and removing it from cradle 140. Because luminous body 24' extends upwardly and away from opening 138 and upper end 122 of elongate body 120 of fixture 23', luminous body 24' is easily accessible so as to be easily taken up by hand for removal from cradle 140.

Cradle 140 is formed of a clear plastic, clear glass, or other light transmissive material or combination of light transmissive materials to permit light emitted from light source 110 to pass or otherwise transmit therethrough. As such, in the first position of fixture 23' attached to base 22 and the first position of luminous body 24' removably held by cradle 140 formed in upper end 122 of elongate body 120 of fixture 23' at opening 138, as illustrated in FIG. 4, luminous body 24' is light coupled by fixture 23' for exposure to light from light source 110 formed in holder 80' of base 22, which again means that light from light source 110 produced by the activation and illumination of light source 110 passes through channel 133 from lower end 121 of elongate body 120 of fixture 23' to bowl 141 of cradle 140, and through bowl 141 of cradle 140 to luminous body 24' at upper end 122 of elongate body 120 of fixture 23' to thereby expose luminous body 24' at opening 138 at upper end 122 of elongate body 120 of fixture 23' to light generated by light source 110.

Again, continuous inner surface 132 of elongate body 120 of fixture 23' that encircles and bounds a channel 133 extending through fixture 23' between lower end 121 and upper end 122 is a reflective surface to reflect light from light source 110 to luminous body 24' in the first position of luminous body 24' removably held by cradle 140. The light reflective character of continuous inner surface 132 is provided by a smooth, shiny finish formed in continuous inner surface 132, such as by buffing. In other examples, a layer of reflective material, such as nickel, aluminum, or the like, may be applied to continuous inner surface 132 of elongate body 120 to provide the reflective surface in fixture 23' at channel 133 to reflect light from light source 110 to luminous body 24' held at upper end 122 of elongate body 120 of fixture 23'.

In the present embodiment, luminous body 24' is formed in the shape of a sphere. Because luminous body 24' is formed in the shape of a sphere in the preferred embodiment, bowl 141 is formed of a complementing half-sphere shape to accept luminous body 24'. Luminous body 24' and bowl 141 may be formed of other complementing shapes without departing from the invention.

Luminous body 24' exhibits luminescence, which is light that occurs at low temperatures by fluorescence, phosphorescence, or the like. This distinguishes luminescence from incandescence, which is light generated at high temperatures by electricity. To provide its luminescent character, luminous body 24' is provided with luminescent material, such as a fluorescent paint or pigment, or a phosphorescent paint or pigment. Preferably, luminous body 24' is formed of phosphorescent resin, such as by conventional casting techniques. In other examples, luminous body 24' is formed of clear plastic, silicone, or the like, impregnated with a glow-in-the-dark pigment, such as a fluorescent or phosphorescent pigment. In other examples, the exterior of luminous body 24' may simply be painted with a fluorescent or phosphorescent paint. Luminous body 24' may solid, as in the present embodiment, or hollow.

In operation, fixture 23' is installed in its first position of fixture 23' attached to base 22 extending upright or otherwise substantially vertically upward with respect to dome 30 of base 22, and luminous body 24' is positioned in its first position removably held by cradle 140 formed in upper end 122 of elongate body 120 of fixture 23' at opening 138, as clearly illustrated in FIG. 4. Plug 70 of power cord 71 is inserted into jack 63 electrically coupling power converter 60 to power cord 72, and plug 72 of power cord is, in turn, inserted into a conventional power socket (not shown) in a conventional and well-known manner to thereby supply electrical power to power converter 60. At this point, switch 61 is activated to activate power converter 60, which receives an input current at an input voltage from wiring 64 and provides an output current at an output voltage to light 111 via wiring 114 and socket 112 thereby activating light 111 causing it to illuminate. Because light 111 is a full spectrum high brightness LED, the output current at the output voltage is set by power converter 60 to provide the high brightness LED forming light 111 with the correct output current and the correct output voltage to allow the high brightness LED forming light 111 to function properly.

In response to activating of light 111, light generates and emits light, which is the present embodiment is full spectrum, high brightness light. With luminous body 24' installed at upper end 122 of elongate body 120 of fixture 23' light coupled to light source 110, luminous body 24' is exposed to this light from light source 110. In response to exposure of luminous body 24' to the light from light source 110, luminous body 24' becomes charged or otherwise energized and, as a result, emits visible light through luminescence for some time after exposure of luminous body 24' to light from light source 110. And so in response to exposure of luminous body 24' to light from light source 110 to charge or energize luminous body 24', luminous body 24' emits visible light. The visible light emitted by luminous body 24' is generated by luminescence, and preferably fluorescence or phosphorescence, which occurs at low temperatures. The visible light emitted by luminous body 24', even when luminous body 24' is being charged or energized, is particularly appreciated in a dark environment, and at night. At night, the visible light 24' emitted by luminous body 24' may be used as a nightlight, which is particularly useful in child's room to provide the child with a nightlight during the night.

Figure 6:
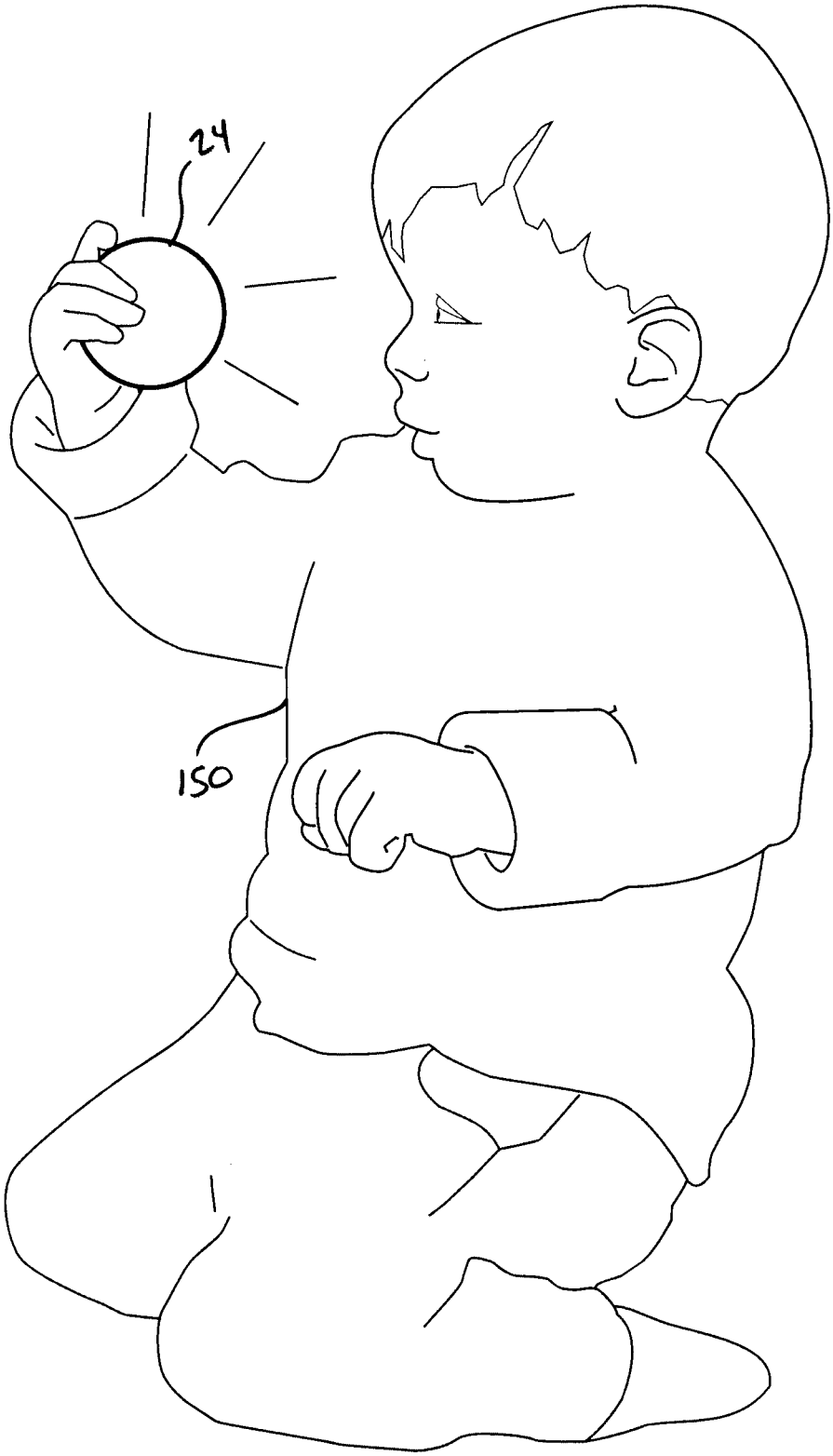
FIG. 6 illustrates a child holding one of the luminous bodies of the luminous lamp apparatus of FIG. 1.

The removability of luminous body 24' from cradle 140 of fixture 24' is particularly advantageous. In particular, at night a user in need of a light source to help see in the dark, such as while walking back and forth between a bedroom and bathroom, may simply take up luminous body 24' in its energized state by hand and remove luminous body 24' from cradle 140 formed in fixture 23', and then hold luminous body 24' while walking in the dark, such that the visible light emitted by luminous body 24' through luminescence provides illumination to illuminate the user's way through the dark. Again, luminous body 24' will emit visible light for some time (such as approximately 30-60 minutes) after exposure of luminous body 24' to light from the light source 110. Because the luminescence of luminous body 24' occurs at low temperatures, luminous body 24' is not hot to the touch and is thus comfortable to pick up and will not burn the hands or cause a fire, in accordance with the principle of the invention. After use of luminous body 24' is no longer required, or luminous body 24' because energy depleted an no longer emits visible light through luminescence, luminous body 24' may simply be re-installed into cradle 140 of fixture 23' to recharge luminous body 24'. As a matter of illustration and reference, FIG. 6 illustrates a child 150 holding luminous body 24' by hand, in which luminous body 24' is energized from exposure to light from light source 110 denoted in FIGS. 4 and 5 and is emitting visible light through luminescence.

According to the principle of the invention, fixture 23' is adapted to removably hold luminous body 24', and fixture 23' is movable between a first position attached to base 22 as illustrated in FIGS. 1, 2, and 3, and a second position removed with respect to base 22 as illustrated in FIG. 3. Rather than a user removing luminous body 24' from fixture 23' and holding luminous body 24' to provide illumination at night to assist the user in walking around in the dark, the user may simply take up fixture 23' by hand, remove fixture 23' from base and then hold fixture 23' with luminous body 24' held in cradle 140 much like a torch to provide the required illumination, and then re-install fixture 23' holding luminous body 24' back onto base 22 upon completion of use. In a particular embodiment if so desired, one or more or all of fixtures 23 may be rigidly secured to base 22, such as by welding, adhesive, by integrally formation such as by injection molding or other selected molding or machining technique, etc.

Those having ordinary skill in the art will readily appreciate than an exemplary luminous lamp apparatus 20 is disclosed, which is easy to construct, easy to use, and that utilizes luminous bodies 24 that are installed with respect to fixtures 23 for exposure to light generated from light sources maintained by base 22, and that emit visible light through luminescence for some time after becoming energized in response to exposure to the light from the light sources maintained by base 22. The visible light emitted by luminous bodies 24 may be used as nightlight, luminous bodies 24 may each be taken up by hand and used to illuminate a user's way in the dark. Again, because fixtures 23 may be removed from base 22, fixtures 23 may each be taken up by hand while holding a luminous body 24 much like a torch to provide illumination in the dark. The LEDs in luminous lamp apparatus 20 are low energy use devices, and because no batteries are employed luminous lamp apparatus 20 has a minimal impact on the environment.

Figure 7:
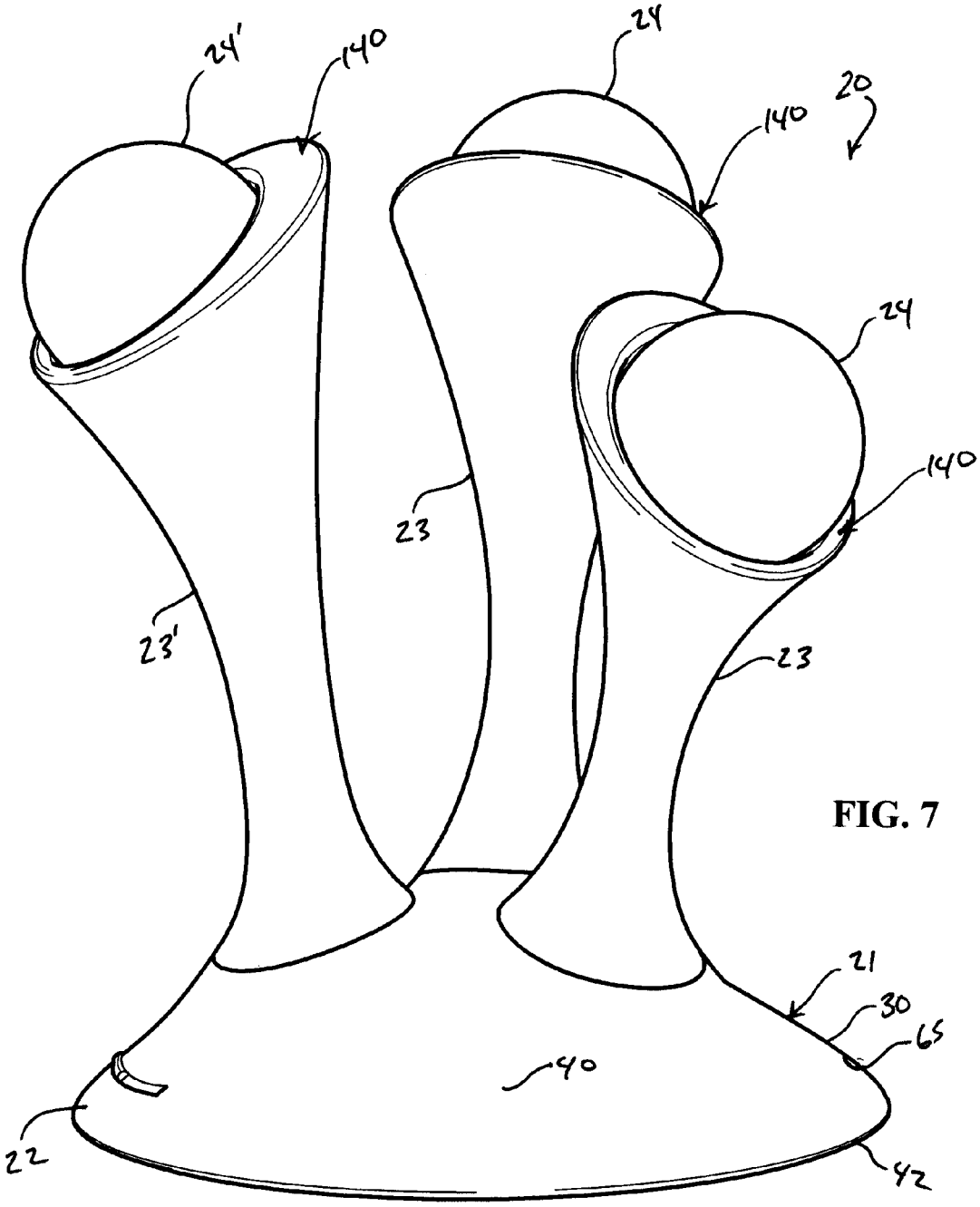
FIG. 7 is a top perspective view of the luminous lamp apparatus of FIG. 1.
Figure 8:
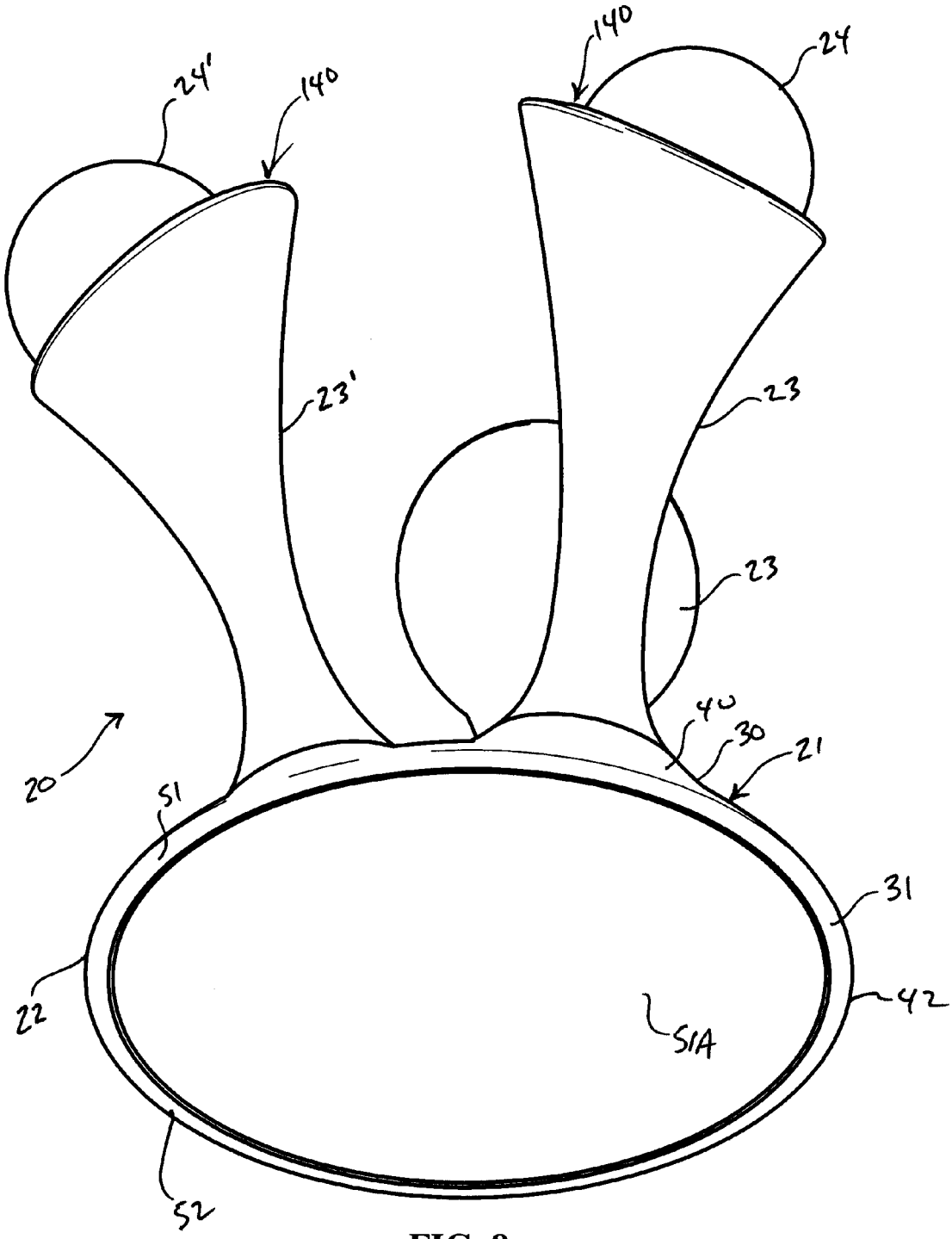
FIG. 8 is a bottom perspective view of the luminous lamp apparatus of FIG. 1.
Figure 9:
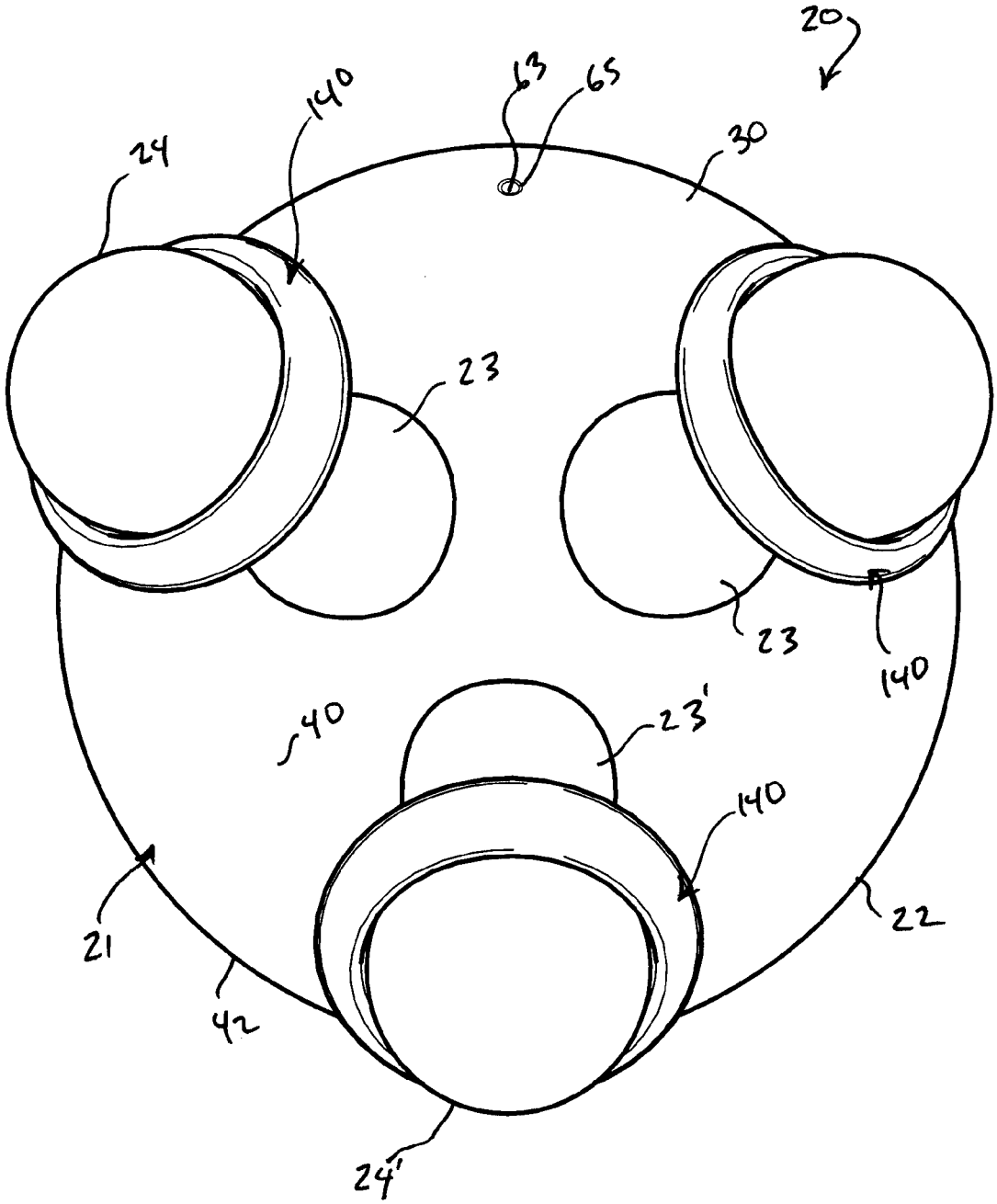
FIG. 9 is a top plan view of the luminous lamp apparatus of FIG. 1.
Figure 10:
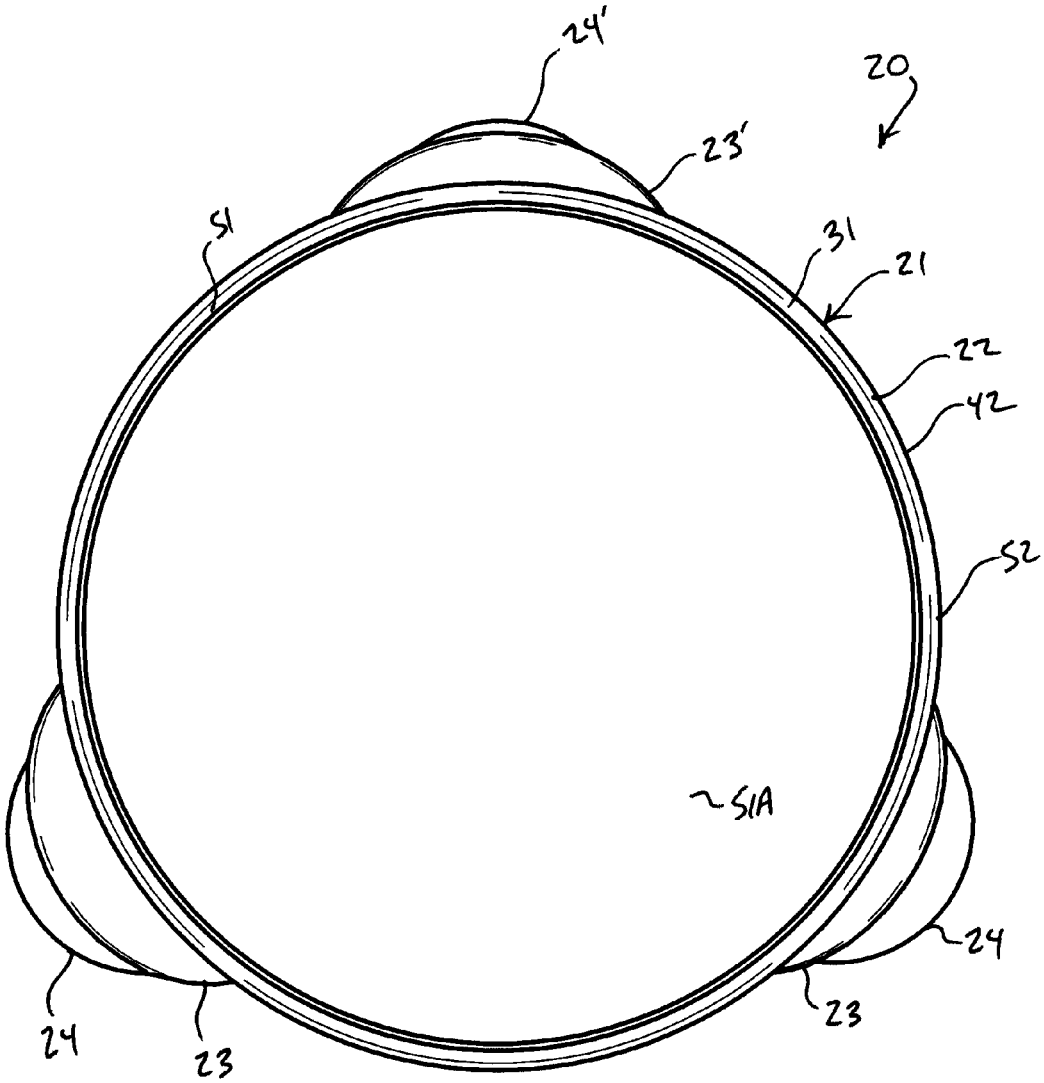
FIG. 10 is a bottom plan view of the luminous lamp apparatus of FIG. 1.
Figure 11:
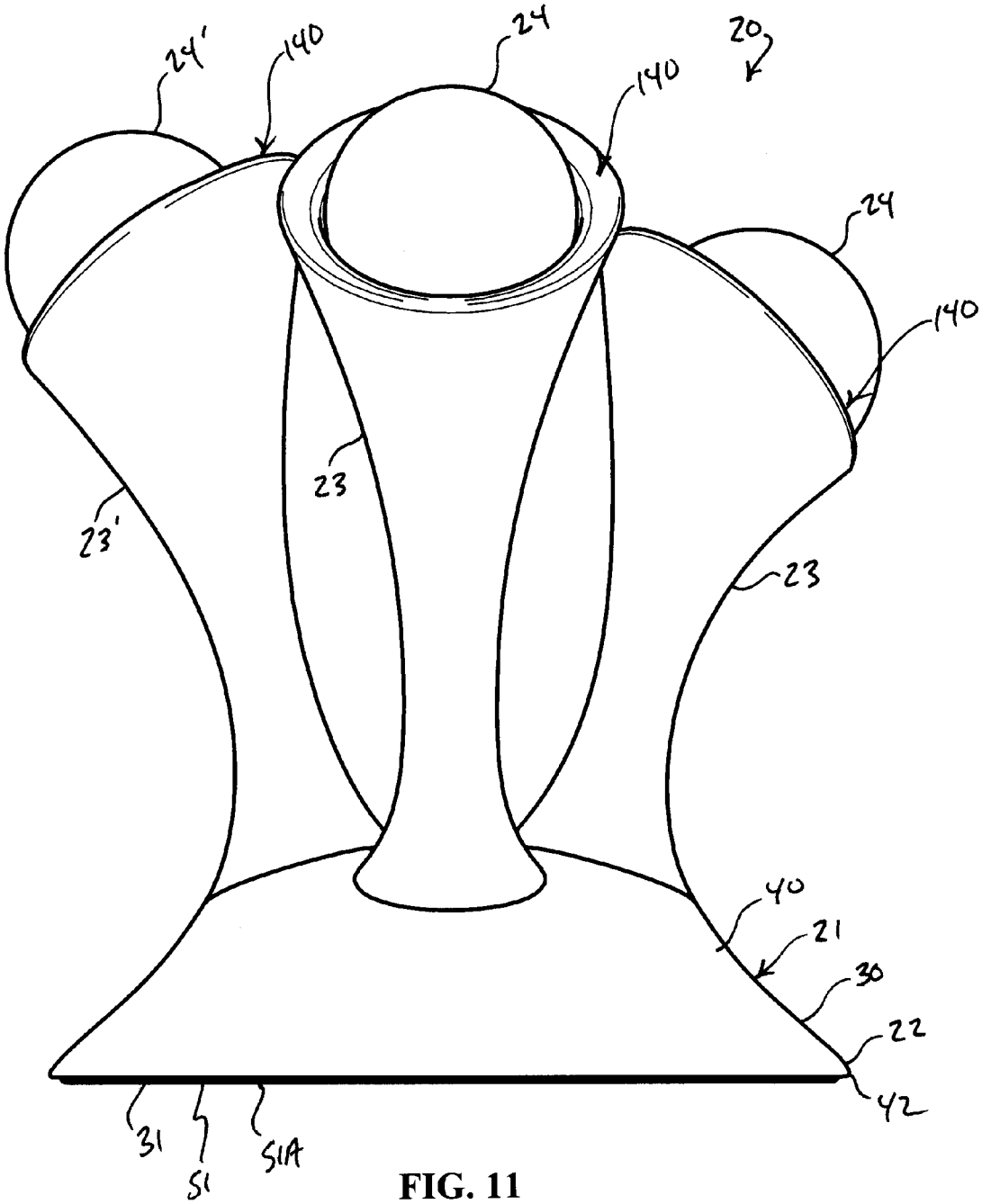
FIG. 11 is a side elevation view of the luminous lamp apparatus of FIG. 1.

As a matter of illustration and reference, FIG. 7 is a top perspective view of luminous lamp apparatus 20 of FIG. 1, FIG. 8 is a bottom perspective view of luminous lamp apparatus 20 of FIG. 1, FIG. 9 is a top plan view of luminous lamp apparatus 20 of FIG. 1, FIG. 10 is a bottom plan view of the luminous lamp apparatus of FIG. 1, and FIG. 11 is a side elevation view of luminous lamp apparatus 20 of FIG. 1.

The present invention is described above with reference to a preferred embodiment. However, those skilled in the art will recognize that changes and modifications may be made in the described embodiment without departing from the nature and scope of the present invention. For instance, although each light source 110 is formed of one light 111 being a conventional and well-known full spectrum, high brightness light emitting diode (LED), and a corresponding socket 112, more can be used to form each light source, such as a cluster of two or more LEDs. Moreover, although each LED is a full spectrum, high brightness LED, the LED forming light source 110 can be the conventional type that cycles though different wavelengths, and thus colors, of visible light.

Various further changes and modifications to the embodiment herein chosen for purposes of illustration will readily occur to those skilled in the art. To the extent that such modifications and variations do not depart from the spirit of the invention, they are intended to be included within the scope thereof.

The invention claimed is:

1. A luminous light apparatus, comprising:

a housing including a cradle, a light source, and a channel formed between the cradle and the light source for transmitting light generated by the light source to the cradle, the channel including a first axis that is oriented at an angle greater than zero degrees with respect to a second axis that is oriented perpendicular to a support surface upon which the housing rests;

a luminous body movable between a first position removably held by the cradle, and a second position removed from the cradle so as to be free to be carried about;

in the first position of the luminous body held by the cradle, the luminous body is exposed to light passing through the channel from the light source to the cradle; and the luminous body for emitting visible light through luminescence after exposure of the luminous body to light from the light source.

2. A luminous light apparatus according to claim 1, further comprising a switch operatively coupled to activate and deactivate the light source.

3. A luminous light apparatus according to claim 1, further comprising at least one reflective surface formed in the channel for reflecting light passing through the channel from the light source to the cradle.

4. A luminous light apparatus, comprising:

a base;

a light source positioned in the base;

a conduit having a lower end attached to the base and extending upwardly therefrom to an opposed upper end;

a cradle coupled to the upper end of the conduit, the cradle including a recessed portion that is at least partially received within the upper end of the conduit;

a channel formed through the conduit from the lower end of the conduit to the cradle and defining a first axis that is oriented at an angle greater than zero degrees with respect to a second axis that is oriented perpendicular to a support surface upon which the base rests, the channel for transmitting light generated by the light source from the lower end of the conduit to the cradle;

a luminous body movable between a first position removably held by the cradle, and a second position removed from the cradle so as to be free to be carried about;

in the first position of the luminous body held by the cradle, the luminous body is exposed to light generated by the light source passing through the channel of the conduit from the lower end of the conduit to the cradle; and the luminous body for emitting visible light through luminescence after exposure of the luminous body to light from the light source.

5. A luminous light apparatus according to claim 4, further comprising a switch formed in the base operatively coupled to activate and deactivate the light source.

6. A luminous light apparatus according to claim 4, further comprising at least one reflective surface formed in the channel for reflecting light from the light source to the cradle.

7. A luminous light apparatus, comprising:

a base;

a plurality of light sources positioned in the base;

a first conduit coupled to the base, the first conduit including:

a lower end and an opposed upper end formed with a first cradle;

a first channel formed through the first conduit from the lower end of the first conduit to the first cradle;

a second conduit coupled to the base, the second conduit including:

a lower end and an opposed upper end formed with a second cradle, a second channel formed through the second conduit from the lower end of the second conduit to the second cradle;

a plurality of luminous bodies, each luminous body held by one of the cradles;

the first conduit movable between a first position attached to the base, and a second position detached from the base;

in the first position the first channel transmitting light generated by one of the plurality of light sources from the lower end of the first conduit to the first cradle, and the respective luminous body held by the first cradle is exposed to light generated by the one of the plurality of light sources passing through the first channel of the first conduit from the lower end of the first conduit to the first cradle;

in the second position the first conduit detached from the base as to be free to be carried about with one of the luminous bodies held by the first cradle; and the one of the luminous bodies for emitting visible light through luminescence after exposure of the luminous body to light from the one of the plurality of light sources.

8. A luminous light apparatus according to claim 7, further comprising a switch formed in the base operatively coupled to activate and deactivate at least one of the plurality of light sources.

9. A luminous light apparatus according to claim 7, wherein each of the plurality of fixtures further includes at least one reflective surface formed in the channel for reflecting light from one of the plurality of light sources to the luminous body held by the cradle.

10. A luminous light apparatus, comprising:

a base;

a plurality of light sources positioned in the base;

a plurality of conduits, each conduit including:

a lower end and an opposed upper end;

a cradle coupled to and at least partially received within the upper end of the conduit, the cradle including a recessed portion that is hemispherically-shaped;

a channel formed through the conduit from the lower end of the conduit to the cradle;

a plurality of luminous bodies movable between a first position removably held by the respective cradle, and a second position removed from the respective cradle so as to be free to be carried about;

a first one of the conduits movable between a first position attached to the base, and a second position detached from the base;

wherein the channel of the first conduit is configured to transmit light from one of the plurality of light sources to one of the luminous bodies through the cradle when the luminous body is in the first position and the first conduit is in the first position;

wherein the first conduit is free to be carried about when in the second position detached from the base, and the luminous body emitting visible light through luminescence after exposure of the luminous body to light from the one of the plurality of the light sources.

11. A luminous light apparatus according to claim 10, further comprising a switch formed in the base operatively coupled to activate and deactivate at least one of the plurality of light sources.

12. A luminous light apparatus according to claim 10, wherein each of the plurality of conduits further includes at least one reflective surface formed in the channel for reflecting light from one of the plurality of light sources to the luminous body held by the cradle.

13. A luminous light apparatus according to claim 4, wherein the recessed portion of the cradle is hemispherically-shaped.

* * * * *